US005375766A

United States Patent [19]

Sweeney

[11] Patent Number: 5,375,766

[45] Date of Patent: Dec. 27, 1994

[54] HOT MELT ADHESIVE SPRAY DISPENSER

[75] Inventor: Stephen J. Sweeney, Barking, England

[73] Assignee: The Dexter Corporation, Seabrook, N.H.

[21] Appl. No.: 37,262

[22] Filed: Mar. 26, 1993

[51] Int. Cl.[5] ..... B05B 1/24

[52] U.S. Cl. ..... 239/133; 239/322; 239/298; 222/146.5; 219/230; 219/421; 401/2

[58] Field of Search ..... 239/133, 132, 134, 322, 239/290, 296, 298; 222/146.5, 389; 219/230, 421; 401/1, 2; 126/401, 226, 239, 229, 234

[56] References Cited

U.S. PATENT DOCUMENTS

| | | | |
|---|---|---|---|
| 2,556,609 | 6/1951 | Arkless | 239/133 |
| 2,742,142 | 4/1956 | Paulsen . | |
| 2,974,874 | 3/1961 | Raymond | 219/421 |
| 3,877,610 | 4/1975 | Dickey | 222/146.5 |
| 3,951,308 | 4/1976 | Thirtle | 222/146.5 |
| 4,124,163 | 11/1978 | Siegmann . | |
| 4,335,677 | 6/1982 | Nagata et al. | 239/406 |
| 4,394,967 | 7/1983 | Amiaut | 239/133 |
| 4,457,457 | 7/1984 | Dziki | 222/146.5 |
| 4,546,923 | 10/1985 | Ii | 239/406 |
| 4,601,597 | 7/1986 | Bertram et al. | 222/146.5 |
| 4,642,158 | 2/1987 | Steinel et al. | 222/146.5 |
| 4,669,661 | 6/1987 | Otto | 239/133 |
| 4,785,996 | 11/1988 | Ziecker et al. | 239/298 |
| 4,969,602 | 11/1990 | Scholl | 239/298 |
| 5,020,723 | 6/1991 | Crist | 239/133 |
| 5,050,776 | 9/1991 | Rosenplanter | 239/133 |
| 5,102,484 | 4/1992 | Allen et al. | 239/298 |

OTHER PUBLICATIONS

Fastening Technology, Inc., Brochure For "Pam 600/PAM 600 Spray Melt" (Publication Date Unknown).

Fastening Technology, Inc., Operating Instructions For PAM 600/600 Spraymatic (Apparent Date, Aug., 1988).

*Primary Examiner*—Karen B. Merritt

*Attorney, Agent, or Firm*—Renner, Otto, Boisselle & Sklar

[57] ABSTRACT

A hot melt adhesive dispensing apparatus comprises a housing including a supply chamber for receiving and holding a solid adhesive, an electrically powered heater, and a spray nozzle assembly. A pneumatically actuated plunger pushes solid adhesive towards the melt chamber wherein the solid adhesive is progressively melted for passage into the spray nozzle assembly which includes a plurality of air jets which impinge upon the stream of melted adhesive exiting a nozzle to create an adhesive spray.

24 Claims, 3 Drawing Sheets

HOT MELT ADHESIVE SPRAY DISPENSER

The invention herein described relates generally to a hand-held apparatus for dispensing hot melt thermoplastic adhesive and, more particularly, to such an apparatus which is uniquely configured to provide an adhesive spray using a solid adhesive that is melted on demand.

BACKGROUND

Hot melt thermoplastic adhesives have been widely used in industry for adhering many types of products and are particularly useful in applications where quick setting time is advantageous. Oftentimes it is desirable to dispense the adhesive as a spray. Prior art adhesive spray dispensers have included a spray head or gun which is supplied with hot melt adhesive in a molten state from a supply thereof such as a melt pot. Such dispensers are suitable for many applications and especially those applications requiring dispensing of large quantities of adhesive. However, the time and cost associated with starting up and shutting down these spray dispensing systems makes them not well suited for those applications where there is a need to spray relatively small quantities of adhesive at irregular intervals.

Another type of hot melt adhesive dispenser uses a solid adhesive typically in cylindrical stick form that is melted in the dispenser on demand. Different mechanisms have been used to advance the adhesive into and through a melt chamber or region, including rachet-type feed mechanisms, cocked ring-type feed mechanisms, and pneumatic feed mechanisms. An exemplary pneumatic hot melt adhesive dispenser is the Hysol 4000 dispenser sold by The Dexter Corporation of Seabrook, N.H. These dispensers, however, have not been known to issue a spray of adhesive. Instead, usually an adhesive bead is dispensed from the nozzle of the gun.

Accordingly, a need exists for a melt-on-demand hot melt adhesive spray dispenser, especially in the form of a hand-held, easily manipulable self-contained unit.

SUMMARY OF THE INVENTION

The present invention satisfies the aforesaid need by the provision of an apparatus which is uniquely configured to provide a hot melt adhesive spray using a solid adhesive that is melted on demand.

A hot melt adhesive dispensing apparatus according to the invention comprises a supply chamber for receiving and holding a charge of solid adhesive, an electrically powered heater for melting the solid adhesive, and a spray nozzle member including an adhesive passageway having an inlet end for receiving the melted adhesive and an outlet end from which a stream of the melted adhesive exits the spray nozzle member, the spray nozzle member further including an air passageway or receiving pressurized air from a source thereof and for emitting the pressurized air through a discharge end thereof proximate the stream of melted adhesive exiting from the spray nozzle member to generate a spray of the melted adhesive. A feed mechanism is provided for forcing melted adhesive to and through the adhesive passageway, as is a manually operated device for controlling application of force by the feed mechanism to the adhesive along with the supply of pressurized air to the air passageway. Provision also is made for preheating the pressurized air supplied to the air passageway and directing a burst of pressurized air to the air passageway upon release of force acting on the adhesive to prevent dripping.

In a preferred embodiment, the heater includes a melt chamber located at one end of the supply chamber, and the heater is operative to progressively melt the solid adhesive as it is urged into the melt chamber by the feed mechanism. The feed mechanism includes a plunger movable in the supply chamber in one direction for forcing melted adhesive into the adhesive passageway and in an opposite direction to permit loading of solid adhesive into the supply chamber. As is preferred, the plunger is pneumatically actuated and an air distribution system is provided to supply pressurized air to the plunger and to the air passageway in the spray nozzle member. The air distribution system includes a valve for connecting and disconnecting the plunger and air passageway to and from a source of pressurized air. Preferably, the housing is in the form of a pistol and the valve is operated by an actuator in the form of a finger operated trigger.

In a preferred embodiment, the air passageway in the spray nozzle member produces a converging swirling flow of air that blows the stream of melted adhesive exiting from the spray nozzle member into a desired pattern that may be varied from a swirl to a random (cobweb) spray pattern. The spray pattern is varied by adjustment of a variable metering orifice in the form of a needle valve which meters flow of pressurized air to the air passageway. Preferably, the spray nozzle member includes a nozzle body including the adhesive passageway extending along an axis of the nozzle body and a spray cap surrounding the nozzle body. The spray cap and nozzle body define between confronting surfaces thereof the discharge end of the air passageway which generally circumscribes the nozzle body coaxially with the adhesive passageway. At least one of the confronting surfaces has formed therein helical grooves which collectively form the air passageway and direct an annular array of angled air jets towards the stream of melted adhesive exiting from the spray nozzle member. To achieve greater spray output flow, the dispenser may be provided with multiple spray nozzle members each emitting a spray of adhesive.

Further in accordance with the invention, a dispensing apparatus for spraying hot melt adhesive on demand, comprises a lower handle portion and an upper barrel portion including a supply chamber for receiving and holding a supply of a solid hot melt adhesive, an electrically powered heater including a melt chamber located at one end of the supply chamber, a pneumatically actuated plunger movable in the supply chamber in one direction for urging the solid adhesive towards the melt chamber and in an opposite direction to permit loading of solid adhesive into the supply chamber, the heater being operative to progressively melt the solid adhesive as it is urged into the melt chamber by the plunger, and a spray nozzle member including an adhesive passageway having an inlet end connected to the melt chamber for receiving the melted adhesive and an outlet end from which a stream of the melted adhesive exits the spray nozzle member, and the spray nozzle member further including an air passageway for receiving pressurized air form a source thereof and for emitting the pressurized air through a discharge end thereof proximate the stream of melted adhesive exiting from the spray nozzle member to generate a spray of the melted adhesive.

As is preferred, the plunger is mounted with respect to the supply chamber such that it can be swung clear of the supply chamber to permit loading of solid adhesive into the supply chamber. Also, the supply chamber, melt chamber and spray nozzle member have respective longitudinal axes thereof that are coaxially aligned, and the handle portion has a longitudinal axis that extends generally perpendicularly to the coaxially aligned axes of the supply chamber, melt chamber and spray nozzle. A switch is provided for connecting and disconnecting the heater to and from a source of electrical power.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
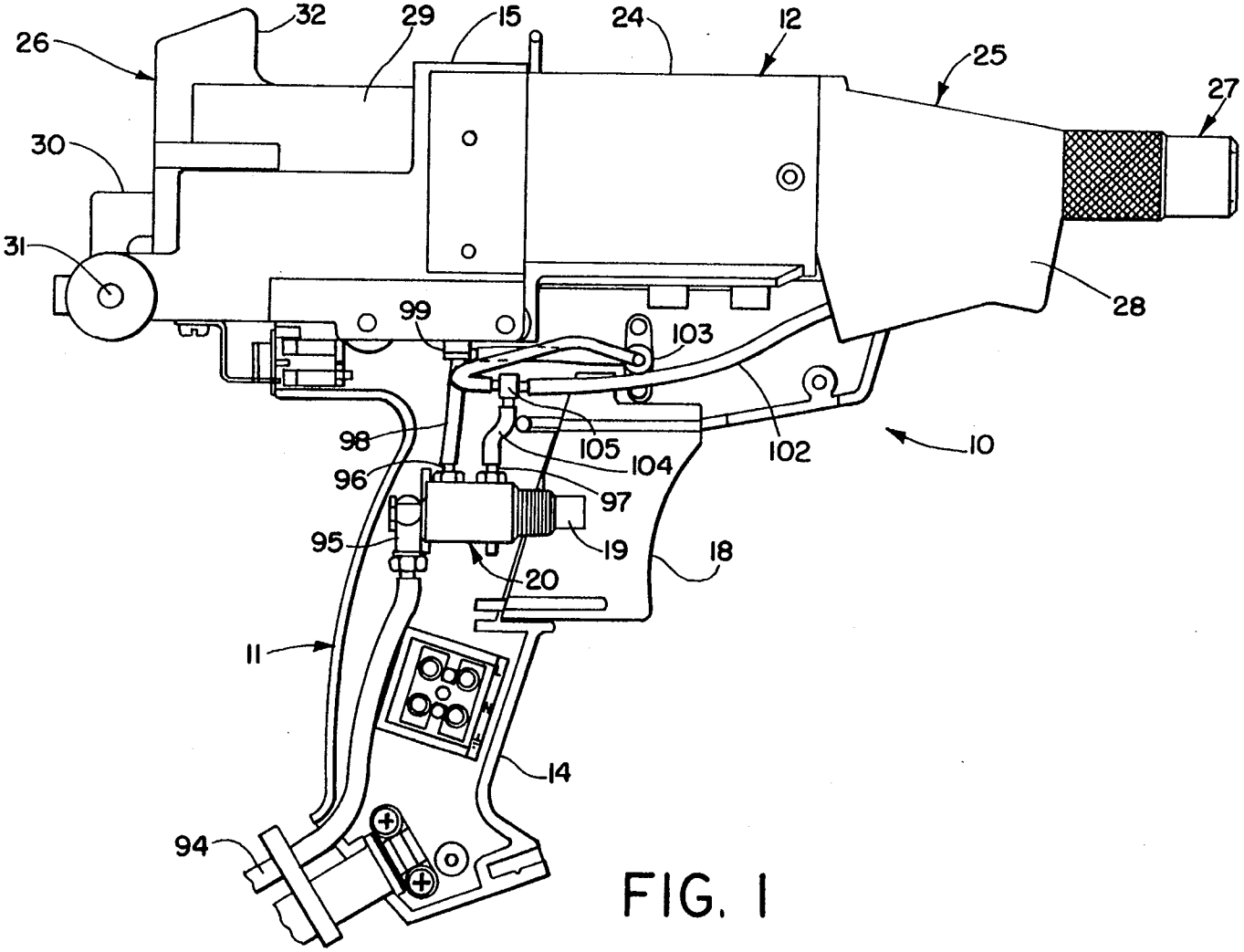
FIG. 1 is an elevational view of a hot melt adhesive spray dispenser with parts of the handle portion thereof removed for illustrative purposes.

Referring now in detail to the drawings and initially to FIG. 1, an exemplary and preferred embodiment of hot melt adhesive spray dispenser according to the invention is indicated generally at 10. The spray dispenser 10 is in the form of a pistol having a lower handle portion 11 and an upper barrel portion 12. The handle portion 11 includes a handle 14 consisting of two parts or halves which, by means of suitable fasteners, are secured together at their lower ends and are secured at their upper ends to a support member 15 in the upper barrel portion 12. The handle 14 houses a number of the electrical and pneumatic components of the dispenser. In FIG. 1, the handle part closest the viewer has been removed, as have some electrical wiring components, to provide an unobstructed view of the pneumatic components housed in the casing.

The handle portion 11 also includes a trigger 18 which is assembled between the two parts of the handle 14 for forward/rearward movement in conventional manner. The trigger 18 is connected to the plunger 19 of a pneumatic pressure regulating control valve 20 which, in the hereinafter described manner, delivers air at variable pressure when the trigger is depressed (squeezed) a proportional distance. When the trigger is not depressed, the biasing element of the control valve, which is of the normally closed type, urges the trigger to its undepressed position illustrated in FIG. 1. The operation of the trigger operated, pressure regulating control valve is hereinafter discussed along with the other pneumatic components of the dispenser.

The upper barrel portion 12 of the dispenser 10 generally includes a supply (feed) chamber 24 for receiving hot melt thermoplastic adhesive in a solid state, a heater assembly 25 for melting the solid adhesive, a plunger assembly 26 for advancing the solid adhesive into the heater assembly, and a spray nozzle assembly 27 for producing a spray of the melted adhesive. The supply chamber 24 is secured at its rear end, to the left in FIG. 1, in a socket formed in the front face of the support member 15. The heater assembly 25 includes a heater housing 28 which is mounted to the forward end of the supply chamber 24 and the nozzle assembly 27 is mounted to the forward end of the heater housing 28. The plunger assembly 26 includes a plunger 29 and a plunger support 30 which supports the plunger for movement along its longitudinal axis within the supply chamber 24, which axis is coaxial with the longitudinal axes of the adhesive flow passages through the heater housing and spray nozzle assembly. The rear end of the plunger support 30 is pivotally connected at 31 to the rear end of the support member 15. When the plunger 29 is fully retracted to the left in FIG. 1 and out of the supply chamber 24, which may be easily accomplished by pulling on finger tab 32, the plunger assembly 26 can be swung upwardly and rearwardly about the pivot connection 31 to permit insertion of a solid body of hot melt adhesive into the supply chamber 24.

Figure 2:
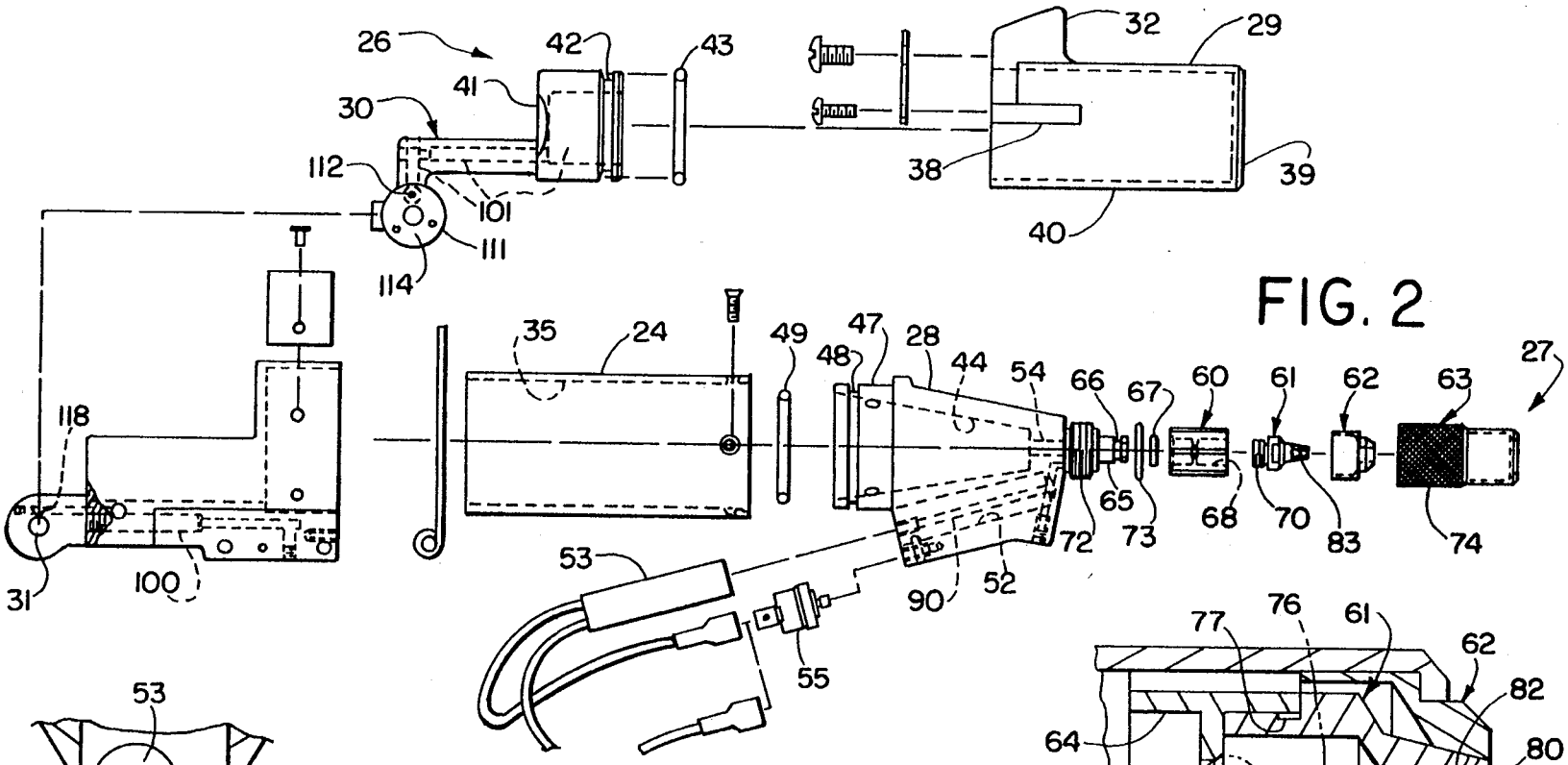
FIG. 2 is an exploded elevational view of the upper barrel portion of the dispenser.

Referring now to FIG. 2, the supply chamber 24 in the illustrated embodiment of the invention has a cylindrical bore 35 for receiving a cylindrical body of hot melt adhesive of corresponding diameter. The cylindrical body of hot melt adhesive is inserted into the supply chamber through the open rear end thereof when the plunger 29 has been swung out of the way in the above described manner. As will be appreciated by those skilled in the art, the supply chamber bore 35 may be provided with a cross-sectional shape other than the preferred circular shape, as might possibly be desired. Also, the solid body of adhesive need not necessarily be a single body having the same diameter as the supply chamber bore 35, although this will usually be the case; rather, two of more bodies of solid hot melt adhesive (or even granular adhesive) may be loaded into the supply chamber bore if desired. By way of example, several smaller diameter adhesive sticks or other shaped adhesive bodies could be loaded into the supply chamber in place of a single larger diameter cylindrical adhesive stick.

After the hot melt adhesive is loaded into the supply chamber 24, the plunger assembly 26 is swung back to align the plunger 29 with the bore 35 in the chamber 24. As seen in FIG. 2, the plunger 29 is in the form of a cylinder which is closed at its forward end by an end wall 39 having a planar front face for pushing against the rear end of the hot melt adhesive body loaded into the supply chamber 24. The plunger preferably is sized to closely fit in the bore 35 of the supply chamber 24 while being coaxially movable within the bore 35.

The cylindrical wall 40 of the plunger is telescoped over a cylindrical guide piston head 41 at the forward end of the plunger support 30. The guide piston head 41 has an annular groove 42 for an O-ring 43 which provides a seal between the cylindrical wall 40 of the plunger and the guide piston head 41. In this manner, a pressure chamber is defined interiorly of the plunger between the closed end wall 39 thereof and the guide piston head 41. Pressurized air may be supplied to this pressure chamber in the hereinafter described manner to move the plunger forwardly in the supply chamber and thereby push the solid hot melt adhesive in the supply chamber forwardly toward the heater assembly 25 wherein the adhesive is progressively melted to its liquid state for passage to and spraying out of the spray nozzle assembly 27. The forward movement stroke of the plunger is limited by an ear or ears 38 thereon engaging a shoulder on the support member 15.

As seen in FIG. 2, the heater housing 28 of the heater 25 has a conical melt chamber 44 coaxial with the bore 35 in the supply chamber 24. The larger diameter end of the melt chamber 44 is at the rear end of the heater housing which is externally configured for insertion into the forward end of the bore 35 in the supply chamber 24. The rear end portion 47 of the heater housing 28 is cylindrical and is provided with an annular groove 48 for an O-ring 49 which provides a seal between the supply chamber and heater housing.

Figure 3:
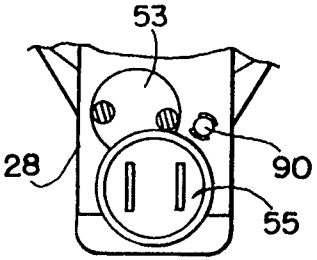
FIG. 3 is a partial end view of the heater housing of the dispenser showing the heater and thermostat assembled in the heater housing.

The heater housing 28 has a heater cartridge bore 52 which in the illustrated embodiment is located adjacent and beneath the tapered melt chamber 44. The heater cartridge bore 52 is coextensive with the melt chamber 44 and houses a resistance-type heater element or cartridge 53. Electrical power is supplied to the heater element 53 to heat the heater housing which in turn heats the hot melt adhesive which is progressively fed into the heater housing by the pneumatically actuated plunger 29. The adhesive is melted in the melt chamber prior to passing through passageway 54 to the spray nozzle assembly 27. The heater element is connected in series with a thermostat 55 secured at its threaded sensor end to the heater housing adjacent the rear end of the heater element. As seen in FIG. 3, the thermostat 55 may partially overlap the end of the heater element to hold it in place within the heater housing. For use with most adhesives, the operating temperature of the block may be in the range of about 230° F. to 450° F.

The spray nozzle assembly 27, which is shown exploded at the right in FIG. 2, comprises a spray adapter 60, a spray nozzle tip 61, a spray cap 62 and a spray nozzle cover 63. The spray adapter 60 has a rearwardly opening bore 64 (FIG. 4) which is telescopically slipped over the cylindrical forward end portion 65 of the heater housing 28. The cylindrical forward end portion 65 of the heater housing has an annular groove 66 for an O-ring 67 which provides a seal between the spray adapter and the end of the heater housing. The spray adapter also has forwardly opening bore 68 and a reduced diameter flow passage 69 (FIG. 4) connecting the rear and forward bores.

The forward bore 68 in the adapter 60 is internally threaded to receive the threaded rear end 70 of the spray nozzle tip 61. After the spray nozzle tip has been screwed into the spray adapter, the spray cap 62 is telescoped over the spray nozzle tip after which the spray nozzle cover 63 is telescoped over the thus assembled spray adapter, spray nozzle tip and spray cap. The spray nozzle cover is internally threaded at its rear end for screwing onto a threaded collar 72 at the forward end of the heater housing. An O-ring 73 is provided to effect a seal between the end of the spray nozzle cover and the heater housing. The outer diameter of the cover has a knurled surface 74 to facilitate finger turning of the cover for easy removal to permit cleaning or nozzle replacement.

Figure 4:
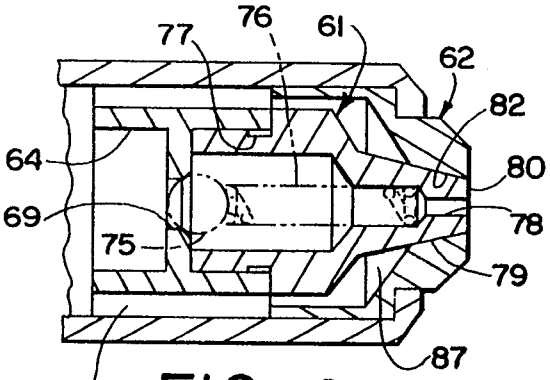
FIG. 4 is a cross-sectional view of the spray nozzle assembly of the dispenser as assembled.

Referring now to FIG. 4, the nozzle tip 61 has an axially extending stepped diameter passageway 77 which may house, if desired, a check valve ball 75 and associated biasing spring 76. The passageway 77 terminates at a relatively small diameter orifice 78 through which the melted adhesive exits the nozzle as a stream or bead of melted adhesive. The forward end of the nozzle tip has a frustoconical outer surface 79 which converges toward the circular front end face 80 of the nozzle which is concentric with the orifice 78. This surface 79 engages a correspondingly tapered frustoconical surface 82 of a center bore through the spray cap 62. The frustoconical surface 79 of the nozzle tip has formed therein a plurality of circumferentially spaced apart helical grooves 83 (FIG. 2). The grooves 83 form between the confronting tapered surfaces of the spray cap and the spray nozzle tip a plurality of air jet passages through which pressurized air is discharged. This arrangement creates a plurality of air jets which generate a converging spiral flow pattern proximate the melted adhesive being extruded out through the orifice 78 in the spray nozzle tip. The air jets blow the stream of melted adhesive exiting from the spray nozzle member into a desired pattern that may be varied from a swirl to a random (cobweb) spray pattern in the hereinafter described manner. As will be appreciated by those skilled in the art, other nozzle configurations may be devised to create other spray patterns.

Figure 5:
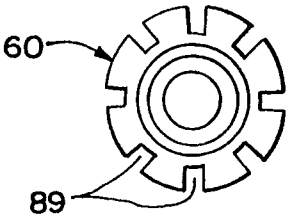
FIG. 5 is an end view of the spray adapter of the spray nozzle assembly.

Pressurized air is supplied to the air jet passages from an annular chamber 87 surrounding the spray nozzle tip 61. The annular chamber 87 is connected by a plurality of axially extending air flow passages 88 formed by longitudinally extending grooves 89 (FIG. 5) in the outer diameter surface of the spray adapter 60. These grooves 89 are in communication with a flow passage 90 in the heater housing 28 which in turn is supplied with pressurized air by means of the hereinafter described air distribution system. As will be appreciated, air supplied to the nozzle assembly will be preheated as it passes through the passage 90 in the heater housing. The length of the passage 90 may be increased, as by giving it a more serpentine path through the housing, to provide for more preheating of the spray air, as may be desired. In the illustrated embodiment, the passage 90 has a rearward portion laterally spaced from and extending parallel to the heater cartridge bore 52, a forward portion laterally spaced from and extending parallel to the adhesive passageway 54, and a generally radially extending intermediate portion connecting the rearward and forward portions.

Referring again to FIG. 1, the air distribution system comprises a main air supply line 94 which passes out through an opening in the lower end of the handle 14 for connection to a source of pressurized air such as, for example, an air compressor. Preferably, the air pressure supplied to the air supply line 94 is regulated within a prescribed range of pressures within which the dispenser is designed to operate such as, for example, between about 50 and 110 psi. The air supply line 94 is connected to the inlet 95 of the trigger operated pressure regulating valve 20 which has a two-way port 96 and exhaust port 97. The port 96 delivers air at variable pressure via air line 98 to a tee fitting 99 when trigger 18 is depressed a proportional distance. One outlet of the tee fitting 99 delivers air to passage 100 (FIG. 2) in the support member 15. As best illustrated in FIG. 2, the air passage 100 is connected through the pivot connection 31, which is further described below, to an air passage 101 in the plunger support 30 which supplies pressurized air to the pressure chamber at the back side of the end wall 39 of the plunger 29. Variable air pressure within this pressure chamber drives plunger 29 forward with variable force. When the trigger 18 is released, the control valve 20 disconnects the air line 98 from supply line 94. At the same time, air flow through air line 98 reverses to relieve pressure from behind the plunger. This reverse air flow is exhausted through the valve 20 to exhaust port 97.

The other outlet of the tee fitting 99 diverts a portion of the air delivered to the tee fitting through air line 102 to the air passage 90 (FIG. 2) in the heater housing 28 for delivery of pressurized air to the nozzle assembly 27. The air line 102 includes a needle valve 103 which restricts the flow volume of air passing from the tee fitting 99 to the passage 90 in the heater housing from where it passes as above described to the spiral grooves in the spray tip which are enclosed by the spray cap. The needle valve may be adjusted to vary the flow volume thereby to vary the spray pattern as desired. A typical needle valve having a slotted head may be used with the head being accessible through an opening in the shell of the handle portion to permit user adjustment of the spray pattern.

As is preferred, the exhaust port 97 of the control valve 20 is connected by exhaust air line 104 to nozzle air line 102 by a tee fitting 105 downstream of the needle valve 103. Accordingly, the exhaust air released through exhaust port 97 from behind the plunger when the trigger is released will flow through the nozzle air line for flow through the spray tip grooves 83 to the atmosphere. The release of the trigger, while relieving air pressure by exhausting air, relieves the forward force of the piston on the adhesive stick in the supply chamber which stops the flow of adhesive almost instantly. The exhaust air requires a finite amount of time of approximately 2 seconds to fully relieve the pressure. During this time any residual adhesive at the nozzle tip is blown clear to prevent dripping. Although preferably the exhaust air is used in the foregoing manner to prevent dripping, other arrangements may be utilized such as temporarily directing a burst of air from the supply line 94 to the spray nozzle when the trigger is released with pressure behind the plunger being otherwise vented to the atmosphere.

As above indicated, the control valve is operable to provide variable pressure to the plunger and also to the spray nozzle assembly 27. More particularly, the control valve may be a valve supplied by Clippard under Part No. CS385. As will be appreciated, the distance the trigger is depressed, may be varied to vary correspondingly the amount of force exerted by the plunger on the adhesive in the supply chamber. The volume of air supplied to the nozzle assembly will be proportionally varied thereby to match the feed rate of melted adhesive exiting the nozzle. Accordingly, the rate at which adhesive is dispensed may be varied by varying the extent to which the trigger is depressed. In the illustrated embodiment the dispenser has a maximum adhesive flow of about 3 pounds per hour at supply pressure of 100 psi with a heater output rating of 400 Watts. The maximum flow rate will vary of course depending on the design pressures and orifice sizes.

Figure 6:
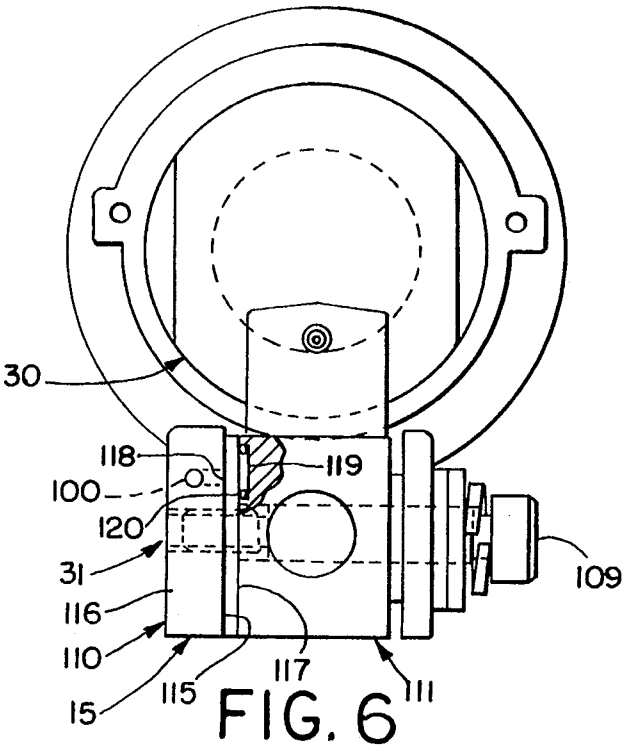
FIG. 6 is an exploded end view of the upper barrel portion of the dispenser.

Referring now to FIG. 6 and also FIGS. 1 and 2, the pivot connection 31 between the plunger support 30 and support member 15 includes a pivot pin 109 in the form of a shoulder bolt. When assembled together, the pivot pin passes through aligned bores in a clevis 110 at the rear end of the support member and an eye 111 at the rear end of the plunger support. The air passage 101 has one end thereof terminating at a port opening 112 (FIG. 2) in a side face 114 of the eye. The air passage 100 in the support member 15 terminates at a port opening 118 (FIG. 2) in the inner surface 115 of the clevis leg 116 adjacent the side face 114 of the eye. When the plunger assembly is in its operating position shown in FIG. 1, the port opening 112 will be aligned with the port opening 118 for passage of pressurized air from the passage 100 to the passage 101. Preferably, the side face 114 has a counterbore 119 at the port opening 112 for containing an O-ring 120 which provides an annular seal around the port opening 112 at the interface with a nylon bearing and gasket seal washer 117 that is interposed between the relatively rotating inner surface 115 and side face 114. The washer 117 is pinned to the eye 111 for rotation therewith and has a hole therein which aligns with port opening 118 when the plunger support 30 is in its dispense position. However, when the plunger support 30 is in its reload position, the opening in the washer 117 (which coincides with the port opening 112, will not be aligned with the port opening 118, thereby preventing any air flow to the plunger in the event that the trigger is accidentally depressed during loading.

Figure 7:
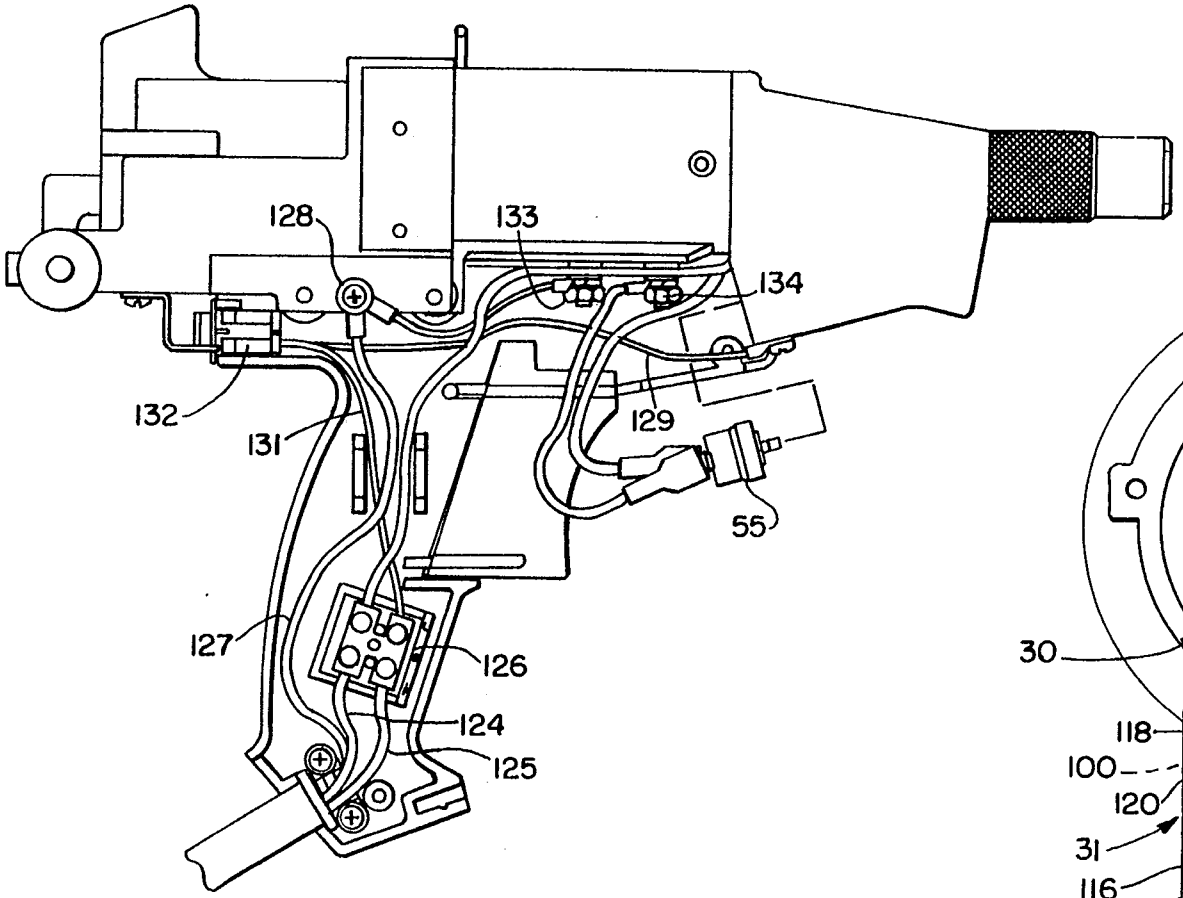
FIG. 7 is a view similar to FIG. 1 but with different parts of the handle portion removed to show the electrical wiring system of the dispenser.

Referring now to FIG. 7, a wiring scheme for the dispenser is illustrated. As shown, the leads 124 and 125 of an electrical cord are attached to respective terminals of a terminal block 126. The electrical cord also includes a ground wire 127 which is connected to the support member 15 at terminal 128 and via a lead wire 129 to the heater housing 28.

Line voltage is supplied via lead 13 1 to an on/off switch 132 which is connected in series with a thermal cut-off (not shown) which is connected between a pair of posts 133 and 134 on a holder mounted to the support member 15. The thermal cut-off preferably is positioned in contact with the supply chamber proximate its forward end. The thermostat 55 also is connected in series with the thermal cut-off along with the heater element 53 (FIG. 2). The thermostat functions to control the temperature of the heater housing which acts as a heat block and the thermal cut-off protects against overheating and also excessive currents as may arise from a short circuit or electrical component failure in the dispenser. When the switch 132 is turned on, power normally is continually supplied to the heater element subject to regulation by the thermostat.

The operation of the dispenser will be evident from the foregoing description. The dispenser may be used with a number of hot melt thermoplastic adhesives including, in particular, hot melt thermoplastic adhesives sold by The Dexter Corporation of Seabrook, N.H., U.S.A. under designations SprayPac 420 and SprayPac 440.

The invention hereof lends itself to the adaptation of known pneumatic hot melt adhesive dispensers. In particular, the above described preferred embodiment of dispenser according to the invention is an adaptation of the Hysol 4000 hot melt adhesive dispenser manufactured by The Dexter Corporation of Seabrook, N.H., to which further reference may be had for further details of the dispenser construction in general.

Although the invention has been shown and described with respect to a preferred embodiment, it will be apparent that equivalent alterations and modifications will occur to others skilled in the art upon the reading and understanding of this specification. For instance, the invention has been described in relation to the use of air as the operative gas, although other gases may be used as may be desired with some types of hot melt thermoplastic adhesives. Accordingly, the references to air herein are intended to encompass other gases as well.

What is claimed is:

1. A dispensing apparatus for spraying hot melt adhesive on demand, comprising a supply chamber for receiving and holding a charge of solid adhesive, an electrically powered heater for melting the solid adhesive, said heater including a melt chamber located at one end of said supply chamber, a spray nozzle member including an adhesive passageway having an inlet end for receiving the melted adhesive and an outlet end from which a stream of the melted adhesive exits said spray nozzle member, and said spray nozzle member further including an air passageway for receiving pressurized air from a source thereof and for emitting the pressurized air through a discharge end thereof proximate the stream of melted adhesive exiting from the spray nozzle member to generate a spray of the melted adhesive, and a feed mechanism for urging the solid adhesive into said melt chamber, said heater being operative to progressively melt the solid adhesive as it is urged into said melt chamber by said feed mechanism.

2. A dispensing apparatus as set forth in claim 1, comprising a manually operated means for controlling application of force by said feed mechanism to the solid adhesive.

3. A dispensing apparatus as set forth in claim 1, comprising a manually operated means for controlling application of force by said feed mechanism to the solid adhesive and the supply of pressurized air to said air passageway.

4. A dispensing apparatus as set forth in claim 3, comprising means for directing a burst of pressurized air to said air passageway upon release of force acting on the solid adhesive.

5. A dispensing apparatus as set forth in claim 1, wherein said feed mechanism includes a plunger movable in said supply chamber in one direction for forcing melted adhesive into said adhesive passageway and in an opposite direction to permit loading of solid adhesive into said supply chamber.

6. A dispensing apparatus as set forth in claim 5, wherein said heater includes a melt chamber located at one end of said supply chamber, and said heater is operative to progressively melt the solid adhesive as it is urged into said melt chamber by said plunger.

7. A dispensing apparatus as set forth in claim 6, comprising pneumatic means for urging said plunger in said one direction.

8. A dispensing apparatus as set forth in claim 7, comprising an air distribution system including means for supplying pressurized air to said pneumatic means and said air passageway in said spray nozzle member.

9. A dispensing apparatus as set forth in claim 8, wherein said air distribution system includes valve means for connecting and disconnecting said pneumatic means and air passageway to the source of pressurized air.

10. A dispensing apparatus as set forth in claim 9, comprising a housing for said supply chamber and electrically powered heater, and wherein said housing is in the form of a pistol and said valve means is operated by an actuator in the form of a finger actuated trigger.

11. A dispensing apparatus as set forth in claim 1, wherein said discharge end of said air passageway produces a converging swirling flow of air around the stream of melted adhesive exiting said spray nozzle member.

12. A dispensing apparatus as set forth in claim 11, wherein said spray nozzle member includes a nozzle body and a spray cap surrounding said nozzle body, said nozzle body including said adhesive passageway extending along an axis of said nozzle body, and said spray cap and nozzle body defining between confronting surfaces thereof the discharge end of said air passageway which generally circumscribes said nozzle body coaxially with said adhesive passageway.

13. A dispensing apparatus as set forth in claim 1, including means for effecting preheating of the pressurized air prior to passage to said air passageway in said spray nozzle member.

14. A dispensing apparatus as set forth in claim 1, comprising adjustable means for metering flow of pressurized air to said air passageway.

15. A dispensing apparatus for spraying hot melt adhesive on demand, comprising a lower handle portion and an upper barrel portion, said upper barrel portion including a supply chamber for receiving and holding a supply of a solid hot melt adhesive, an electrically powered heater including a melt chamber located at one end of said supply chamber, a pneumatically actuated plunger movable in said supply chamber in one direction for urging the solid adhesive towards said melt chamber and in an opposite direction to permit loading of solid adhesive into said supply chamber, said heater being operative to progressively melt the solid adhesive as it is urged into said melt chamber by said plunger, and a spray nozzle member including an adhesive passageway having an inlet end connected to said melt chamber for receiving the melted adhesive and an outlet end from which a stream of the melted adhesive exits said spray nozzle member, and said spray nozzle member further including an air passageway for receiving pressurized air from a source thereof and for emitting the pressurized air through a discharge end thereof proximate the stream of melted adhesive exiting from the spray nozzle member to generate a spray of the melted adhesive.

16. A dispensing apparatus as set forth in claim 15, wherein said plunger is mounted with respect to said supply chamber such that it can be swung clear of said supply chamber to permit loading of solid adhesive into said supply chamber.

17. A dispensing apparatus as set forth in claim 15, wherein said supply chamber, melt chamber and spray nozzle member have respective longitudinal axes thereof that are coaxially aligned, and said handle portion has a longitudinal axis that extends generally perpendicularly to the coaxially aligned axes of said supply chamber, melt chamber and spray nozzle member.

18. A dispensing apparatus as set forth in claim 15, including switch means for connecting and disconnecting said heater to and from a source of electrical power.

19. A dispensing apparatus as set forth in claim 15, comprising pneumatic means for urging said plunger in said one direction, and an air distribution system including means for supplying pressurized air to said pneumatic means and said air passageway in said spray nozzle member.

20. A dispensing apparatus as set forth in claim 19, wherein said air distribution system includes valve means for connecting and disconnecting said pneumatic means and air passageway to the source of pressurized air, and said valve means is operated by an actuator in the form of a finger actuated trigger mounted to said handle portion.

21. A dispensing apparatus as set forth in claim 20, comprising a main supply line connected to said valve means, said valve means being operative simultaneously to connect said pneumatic means and air passageway to said main supply line, and said air distribution system further comprising adjustable means for metering flow of pressurized air to said air passageway.

22. A dispensing apparatus as set forth in claim 15, wherein said air passageway directs the stream of air exiting therefrom in such a manner that it blows the stream of melted adhesive exiting from the spray nozzle member into a cobweb-type spray.

23. A dispensing apparatus as set forth in claim 15, wherein said spray nozzle member includes a nozzle body including said adhesive passageway extending along an axis of said nozzle body and a spray cap surrounding said nozzle body, said spray cap and nozzle body defining between confronting surfaces thereof said air passageway which generally circumscribes said nozzle body coaxially with said adhesive passageway.

24. A dispensing apparatus for spraying hot melt adhesive on demand, comprising a supply chamber for receiving and holding a charge of solid adhesive, an electrically powered heater for melting the solid adhesive, a spray nozzle member including an adhesive passageway having an inlet end for receiving the melted adhesive and an outlet end from which a stream of the melted adhesive exits said spray nozzle member, and said spray nozzle member further including an air passageway for receiving pressurized air from a source thereof and for emitting the pressurized air through a discharge end thereof proximate the stream of melted adhesive exiting from the spray nozzle member to generate a spray of the melted adhesive, pneumatic means for forcing melted adhesive to and through said adhesive passageway, valve means for connecting and disconnecting said pneumatic means and air passageway to the source of pressurized air, and vent means operative upon disconnection of said pneumatic means and air passageway from the source of pressurized air for exhausting pressurized air from said pneumatic means to the atmosphere via said spray nozzle member thereby to produce a burst of pressurized air to clear residual adhesive from said spray nozzle member.

* * * * *